US009994049B1

(12) United States Patent
Boland et al.

(10) Patent No.: US 9,994,049 B1
(45) Date of Patent: Jun. 12, 2018

(54) ADJUSTABLE PATH LENGTH OF PRINT MEDIA IN A DRYER OF A PRINTING SYSTEM

(71) Applicants: Stuart Boland, Denver, CO (US); Scott R. Johnson, Erie, CO (US)

(72) Inventors: Stuart Boland, Denver, CO (US); Scott R. Johnson, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/431,577

(22) Filed: Feb. 13, 2017

(51) Int. Cl.

| | |
|---|---|
| ***B41J 11/00*** | (2006.01) |
| ***B41F 23/04*** | (2006.01) |
| ***B41J 15/02*** | (2006.01) |
| ***B65H 20/02*** | (2006.01) |

(52) U.S. Cl.
CPC ..... *B41J 11/002* (2013.01); *B41F 23/0413* (2013.01); *B41J 15/02* (2013.01); *B65H 20/02* (2013.01); *B65H 2801/03* (2013.01)

(58) Field of Classification Search
CPC ..... B41J 11/002; B41J 15/02; B65H 20/02; B65H 2801/03; B41F 23/0413
See application file for complete search history.

(56) References Cited

U.S. PATENT DOCUMENTS

| | | | |
|---|---|---|---|
| 772,695 | A | 10/1904 | Crowell |
| 3,134,653 | A | 5/1964 | Justus |
| 3,319,352 | A | 5/1967 | Haigh |
| 4,188,731 | A | 2/1980 | Rauskolb |
| 4,658,723 | A | 4/1987 | Tokuno et al. |
| 4,805,111 | A | 2/1989 | Steidel |
| 5,320,036 | A | 6/1994 | Krohn et al. |
| 5,483,887 | A | 1/1996 | Grosshauser |
| 5,528,839 | A | 6/1996 | Seidl |
| 5,571,223 | A | 11/1996 | Dudovicz |
| 5,713,138 | A | 2/1998 | Rudd |
| 5,770,015 | A | 6/1998 | Grossmann et al. |
| 5,775,002 | A | 7/1998 | Iwase et al. |
| 5,979,325 | A | 11/1999 | Mitze et al. |
| 6,006,443 | A | 12/1999 | Karvinen |
| 6,753,949 | B2 | 6/2004 | Hashiguchi |
| 6,944,970 | B2 | 9/2005 | Silverbrook et al. |
| 7,080,465 | B2 | 7/2006 | Fujinami et al. |
| 7,123,281 | B2 | 10/2006 | Okada |
| 7,254,902 | B2 | 8/2007 | Hayasaka et al. |

(Continued)

FOREIGN PATENT DOCUMENTS

| | | | |
|---|---|---|---|
| EP | 2385333 | A1 | 11/2011 |

*Primary Examiner* — Henok Legesse
(74) *Attorney, Agent, or Firm* — Duft Bornsen & Fettig LLP

(57) ABSTRACT

Systems and methods for adjustable path length of print media in a dryer of a printing system. In one embodiment, the dryer includes a drum that applies heat to a web of print media. The dryer also includes first rollers positioned in an arc around the drum to define a path of travel of the web along the arc when the web is between an entrance of the dryer and the drum. The dryer further includes second rollers positioned inside the arc from the first rollers to reverse the path of travel of the web inside the arc when the web is between the drum and an exit of the dryer. A first roller and a second roller transport the web around the drum. A location of the first roller and the second roller relative to the arc defines a length of the web inside the dryer.

20 Claims, 6 Drawing Sheets

(56) References Cited

U.S. PATENT DOCUMENTS

| | | | | |
|---|---|---|---|---|
| 7,440,722 | B2 | 10/2008 | Lofthus et al. | |
| 7,802,377 | B2 | 9/2010 | Kloibhofer et al. | |
| 8,201,936 | B2 | 6/2012 | Ihara | |
| 8,313,188 | B2 | 11/2012 | Muro et al. | |
| 8,348,531 | B2 * | 1/2013 | Godden | B41F 23/0403 101/424.1 |
| 8,478,178 | B2 | 7/2013 | Condello et al. | |
| 8,523,034 | B2 | 9/2013 | Fuchs | |
| 8,662,656 | B2 * | 3/2014 | Hanson | B41J 3/60 347/102 |
| 8,727,525 | B2 | 5/2014 | Houjou | |
| 8,833,924 | B2 | 9/2014 | Velasco et al. | |
| 8,984,764 | B2 | 3/2015 | Rae et al. | |
| 9,096,079 | B2 | 8/2015 | Priebe et al. | |
| 9,248,666 | B2 | 2/2016 | Fuchioka et al. | |
| 9,283,774 | B2 | 3/2016 | Miyasaka | |
| 9,409,416 | B2 | 8/2016 | Onodera et al. | |
| 2003/0031795 | A1 * | 2/2003 | Bosler | B29C 47/0021 427/256 |
| 2005/0280690 | A1 | 12/2005 | Preszler | |
| 2013/0215202 | A1 | 8/2013 | Koller et al. | |
| 2014/0232797 | A1 | 8/2014 | Onodera et al. | |
| 2015/0174921 | A1 | 6/2015 | Onodera et al. | |
| 2015/0346659 | A1 | 12/2015 | Nagayama et al. | |
| 2016/0121624 | A1 * | 5/2016 | Yamada | B41J 11/002 347/102 |
| 2016/0273832 | A1 | 9/2016 | Asada et al. | |
| 2016/0313059 | A1 * | 10/2016 | Boland | F26B 13/14 |

* cited by examiner

ADJUSTABLE PATH LENGTH OF PRINT MEDIA IN A DRYER OF A PRINTING SYSTEM

FIELD OF THE INVENTION

The invention relates to the field of printing systems, and in particular, to dryers of printing systems.

BACKGROUND

Businesses or other entities having a need for volume printing typically use a production printing system capable of printing hundreds of pages per minute. A web of print media, such as paper, is stored the form of a large roll and unraveled as a continuous sheet. During printing, the web is quickly passed underneath printheads which discharge small drops of ink at particular intervals to form pixel images on the web. The web may then be dried and cut to produce a printed product.

Since production printers print high quality images at high speed, it is important that the drying process of the web is quick, effective, and efficient. One such drying mechanism is a hollow metal drum heated with a radiant energy source such as a lamp. The lamp heats the surface of the drum to a desired temperature and the web contacts the heated rotating surface of the drum to dry ink on the web at a controlled temperature. However, in conventional drum dryers, the total path length of the web is fixed. Current drum dryers are therefore limited in ability to adapt to a range of different drying requirements.

SUMMARY

Embodiments described herein provide a drum dryer with an adjustable path length of print media. The dryer includes a central drum and a series of rollers spaced along an arc around the drum. The positioning of the rollers inside the dryer defines a path for a web of print media to follow inside the dryer. The rollers generally comprise two groups: a first group of rollers that transport the web along the arc in a first direction between the dryer entrance and the drum, and a second group of rollers that transport the web along the arc in a second direction generally opposite to the first direction between the drum and the dryer exit. The particular positions of the drum, first group of rollers, and second group of rollers advantageously enable multiple different path lengths of the web inside the dryer, thereby making the dryer highly adaptable to a wide range of drying requirements. The structure is equipped for high-performance drying using a long web path but also facilitates a reduction in paper waste as well as energy cost for shorter web path implementations. A further advantage is that similar amounts of contact between the web and drum may be achieved regardless as to whether a long web path or short web path is implemented for the dryer.

One embodiment is a system that includes a dryer of a printing system. The dryer includes a drum that rotates about an axis and applies heat to a web of print media to dry ink applied to the web. The dryer also includes first rollers positioned in an arc around the drum to define a path of travel of the web along the arc when the web is between an entrance of the dryer and the drum. The dryer further includes second rollers positioned inside the arc from the first rollers to reverse the path of travel of the web inside the arc when the web is between the drum and an exit of the dryer. A first roller and a second roller transport the web around the drum. A location of the first roller and the second roller relative to the arc defines a length of the web inside the dryer.

In a further embodiment, the length of the web inside the dryer is a first distance when the location of the first roller and the second roller is at a far end of the arc with respect to a travel distance of the web from the entrance of the dryer. The length of the web inside the dryer is a second distance that is less than the first distance when the location of the first roller and the second roller is between the far end of the arc and a near end of the arc that is closer to the entrance of the dryer than the far end of the arc. The length of the web inside the dryer is a third distance less than the second distance when the location of the first roller and the second roller is at the near end of the arc.

Another embodiment is a web handling apparatus that includes an enclosure with an entrance for receiving a web with wet ink and an exit for discharging the web with dried ink, and a drum that occupies a center of the enclosure and heats the web as the web wraps around the drum. The web handling apparatus also includes a first group of rollers spaced along an arc that spans around a circumferential portion of the drum at a first distance from the surface of the drum. The first group of rollers transports the web between the entrance of the enclosure and the drum. A last roller among the first group of rollers turns the web onto the drum. The web handling apparatus further includes a second group of rollers that occupy spaces between the first group of rollers. The second group of rollers are positioned inside the arc to span around the drum at a second distance closer to the surface of the drum than the first distance. The second group of rollers transport the web between the drum and the exit of the enclosure. A third group of rollers are positioned closer to the drum than the second distance. One roller among the third group of rollers transports the web from the drum to the second group of rollers. A location of the last roller and the one roller relative to the arc defines a travel distance of the web inside the enclosure.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
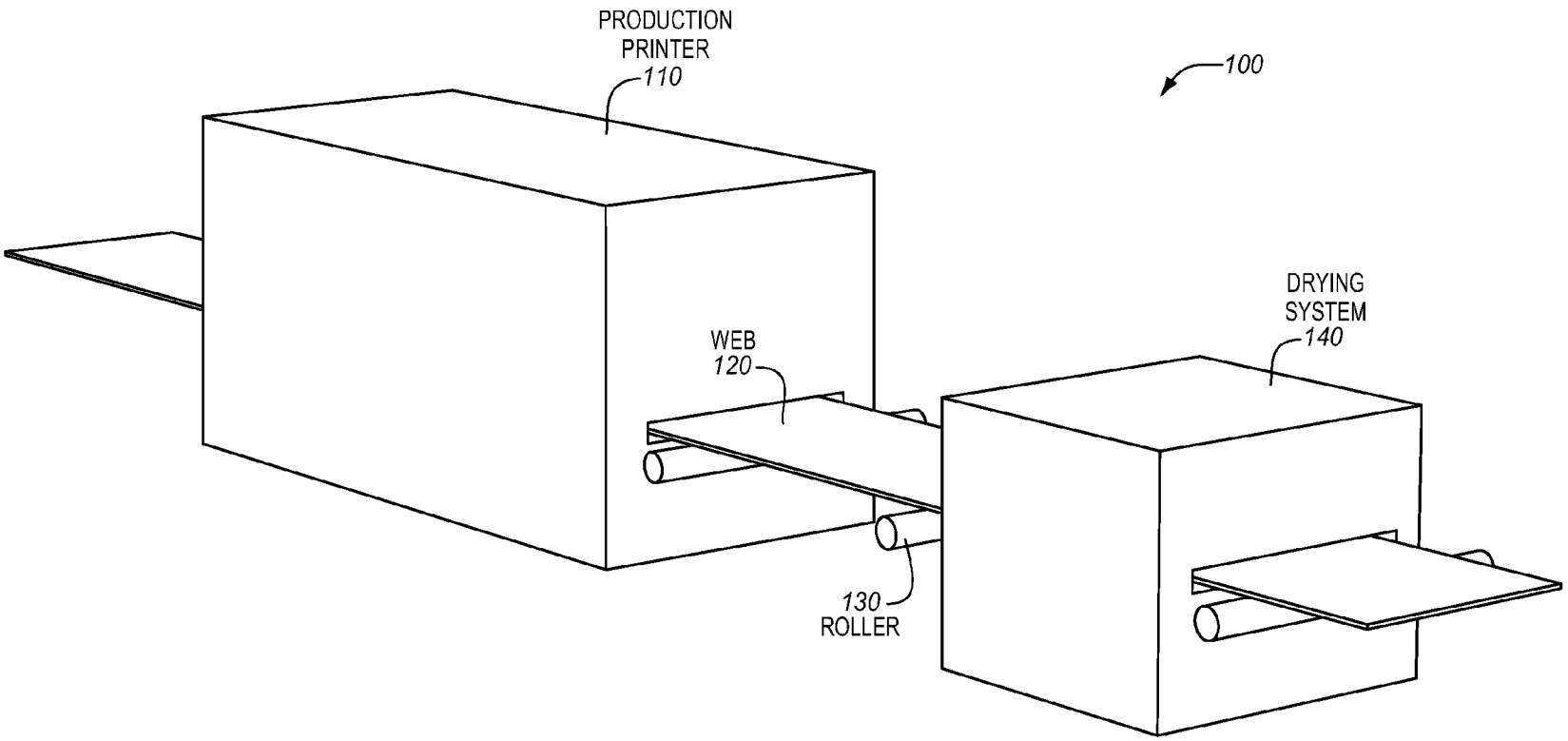
FIG. 1 illustrates an exemplary continuous-forms printing system.

FIG. 1 illustrates an exemplary continuous-forms printing system 100. Printing system 100 includes production printer 110, which is configured to apply ink onto a web 120 of continuous-form print media (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), Key (K) black, white, or clear inks. The ink applied by printer 110 onto web 120 is wet, meaning that the ink may smear if it is not dried before further processing. One or more rollers 130 position web 120 as it travels through printing system 100. Printing system 100 also includes drying system 140, which is any system, apparatus, device, or component operable to dry ink applied to web 120. Printer 110 is upstream from the dryer since web 120 travels downstream from printer 110 to drying system 140. Printer 110 and drying system 140 may be separate devices or one integrated device.

Figure 2:
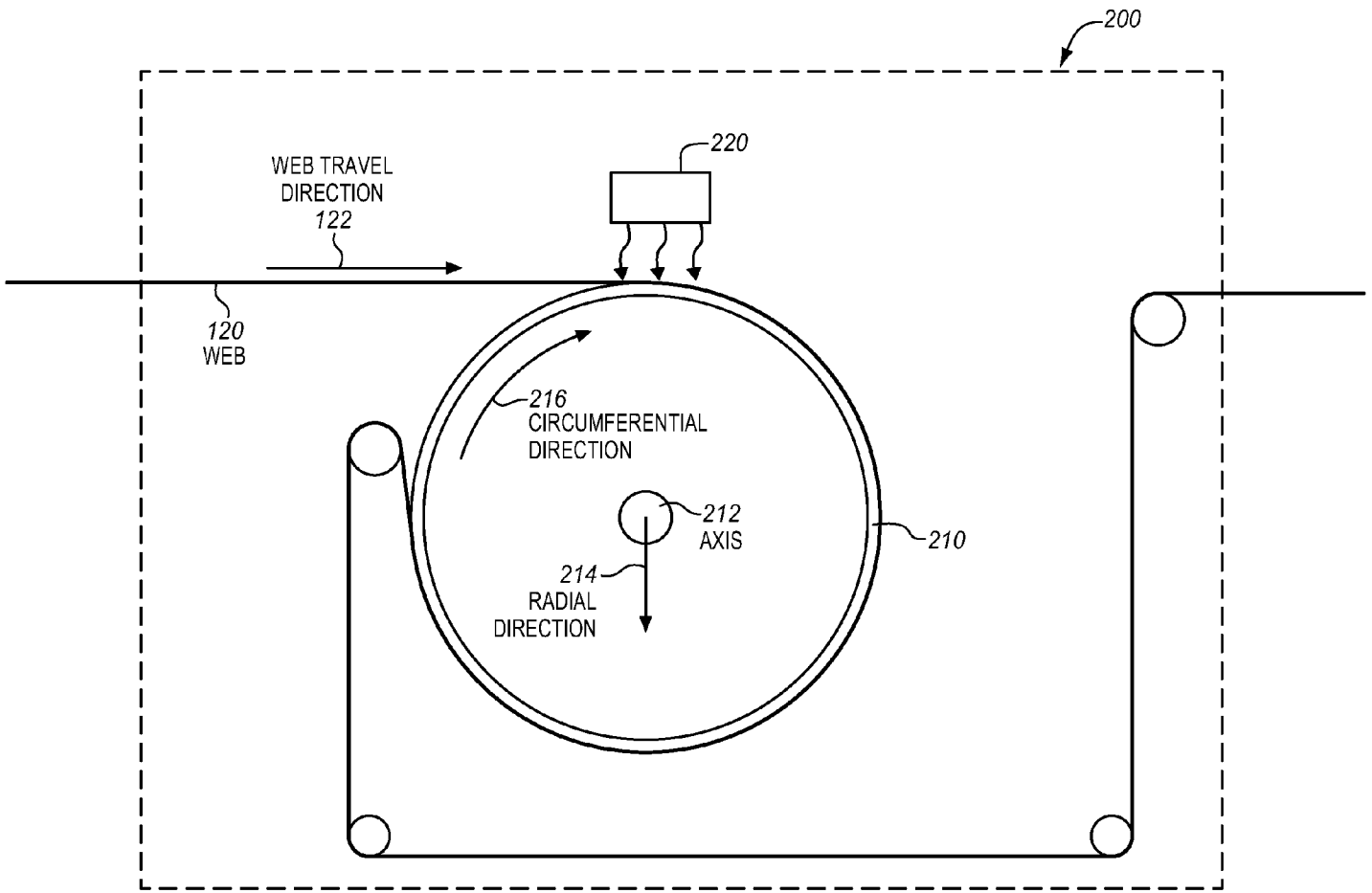
FIG. 2 illustrates a side view of a drying system that includes a drum in an exemplary embodiment.

FIG. 2 illustrates a side view of a drying system 200 that includes a drum 210 in an exemplary embodiment. In general, drum 210 includes a cylindrical body with a thermally conductive surface on its outer circumference. During operation, web 120 is marked with ink by a print engine, enters drying system 200 as it travels along web travel direction 122, and wraps around an outer surface of rotating drum 210, which is heated to a desired temperature via heat transfer of a radiant energy source 220. Drum 210 rotates about axis 212, and components of drying system 200 may therefore be described with respect to a radial direction 214 which is any direction along a straight line from axis 212 or center of drum 210, and a circumferential direction 216 which is analogous to a rotational direction of drum 210 that is perpendicular to radial direction 214. Although drum 210 provides consistent and even heating of web 120, conventional drying systems such as that shown in FIG. 2 have a relatively low degree of drying adaptability since the total path length of web 120 is constant and relatively short and drying adjustments are limited to simply increasing/decreasing heat output of radiant energy source 220 for corresponding temperature changes on surface of drum 210.

Figure 3:
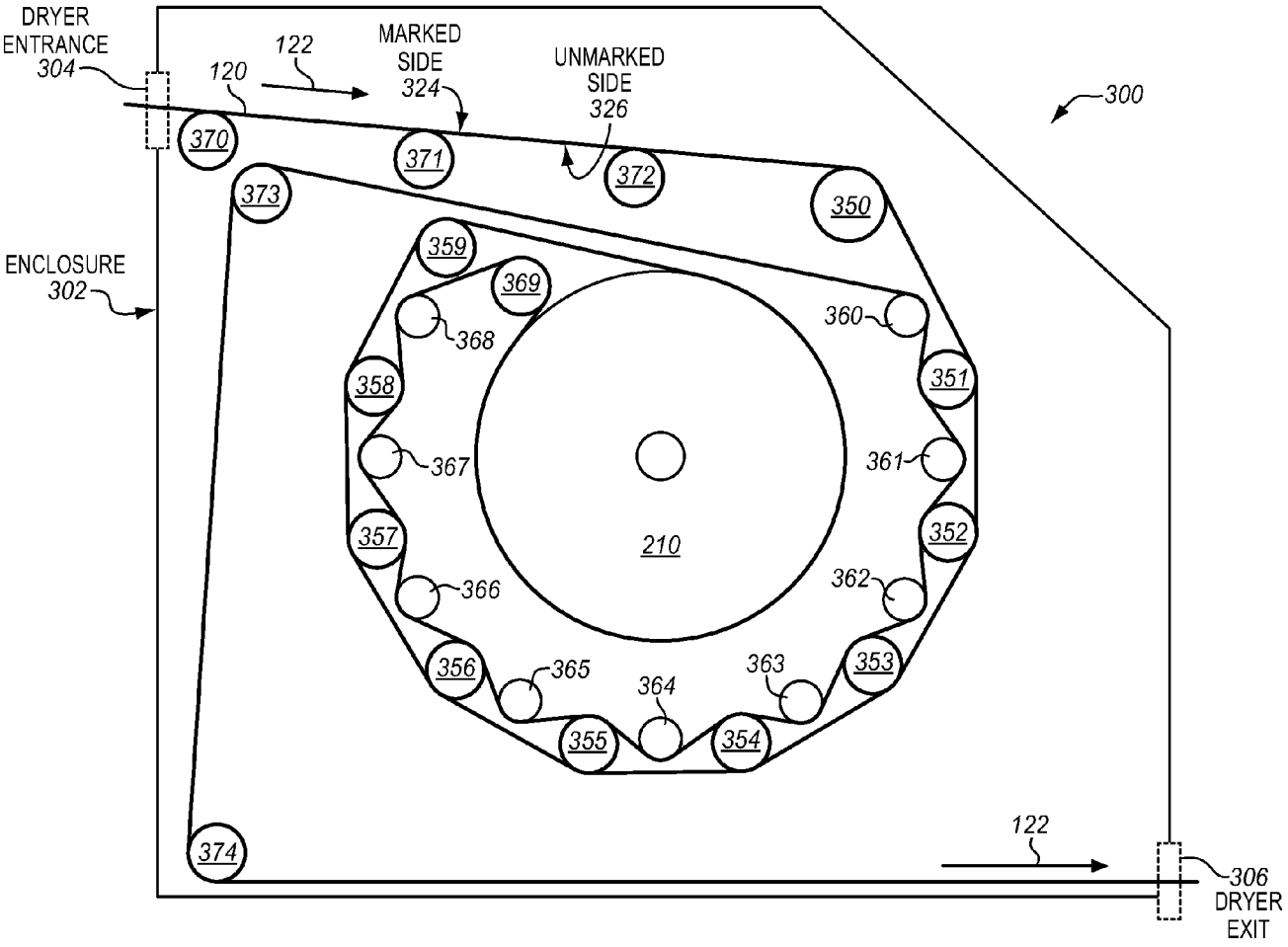
FIG. 3 illustrates a drying system that includes a drum and is enhanced with a roller configuration that extends the path length of a web in an exemplary embodiment.

FIG. 3 illustrates a drying system 300 that includes drum 210 and is enhanced with a roller configuration that extends the path length of web 120 in an exemplary embodiment. In general, drying system 300 includes two groups of rollers: a series of first rollers 350-359 spaced along an arc around drum 210, and a series of second rollers 360-369 spaced along the arc around drum 210. Drum 210 is generally positioned inside the arc and has a larger circumference than rollers 350-359/360-369, and the positioning of rollers 350-359/360-369 generally defines the arc and the path for web 120 to follow inside enclosure 302. That is, the web path in drying system 300 is a passage for web 120 to follow from dryer entrance 304 to dryer exit 306 and is determined by the engaged surfaces of drum 210 and rollers 350-359/360-369. The web paths are shown in the figures by the line of web 120, and the web path determines the length of web 120 inside of the dryer.

After printing, web 120 enters an enclosure 302 of drying system 300 at dryer entrance 304 with a marked side 324 that is wet with an applied ink and an unmarked side 326 that does not have wet ink (or which has been previously marked and already dried). Web 120 may travel over one or more entrance rollers 370-372 before encountering the first rollers 350-359. The first rollers 350-359 transport (i.e., guide) web 120 along a first path of the arc in a first direction (e.g., clockwise direction or first circular direction). One or more of the first rollers 350-359 may be heated internally or externally for drying ink applied to web 120. A roller (e.g., roller 359) among the first rollers 350-359 which is last along the arc turns web 120 toward drum 210. Web 120 then wraps around a circumferential portion drum 210 which applies further heat to web 120.

After traveling around drum 210, web 120 encounters the second rollers 360-369. A roller (e.g., roller 369) among the second rollers 360-369 which is first to receive web 120 from drum 210 may be positioned adjacent to the last roller (e.g., roller 359) of the first rollers 350-359. Accordingly, one roller from each group (e.g., rollers 369/359) may tension/transport web 120 around a substantial circumferential portion of drum 210 (e.g., wrap/contact angle of 300 degrees or more). The second rollers 360-369 transport web 120 along a second path of the arc in a second direction which is generally opposite from the first direction (e.g., counter-clockwise direction or a second circular direction opposite to the first circular direction). After traveling the arc again in the reversed direction, web 120 may travel over one or more exit rollers 373-374 before leaving drying system 300 through dryer exit 306 of enclosure 302.

As shown in FIG. 3, one or more of the first rollers 350-359 and one or more of the second rollers 360-369 may interlace with one another. An interlaced roller configuration refers to a relative position between a first roller (e.g., one or more of first rollers 350-359) and a second roller (e.g., one or more of second rollers 360-369) in which the rollers have opposite rotation directions, overlap along the radial direction 214, and are offset from one another in a direction perpendicular to the radial direction 214 (e.g., circumferential direction 216 in drying system 300 and/or travel direction of web 120). In other words, the second rollers 360-369 may occupy the spaces between the first rollers 350-359 along the arc or circumferential direction 216 such that web 120 alternates contact with second rollers 360-369 and first rollers 350-359 as it travels in the second direction between drum 210 and dryer exit 306.

The amount of overlap, or relative distance between a second roller 360-369 and a first roller 350-359 along the radial direction 214, imparts a corresponding amount of contact/heat between web 120 and the first rollers 350-359 as web 120 travels in the second direction. Though ink applied to the marked side 324 of web 120 may be sufficiently dry so as not to smear by the time it begins to contact the second rollers 360-369 (e.g., second roller 369 that first receives web 120 from drum 210), it may be desirable for a number of reasons to further transfer heat to web 120 with the first rollers 350-359 to condition web 120 for sufficient print/drying quality. Thus, when drying system 300 is configured with interlaced rollers, web 120 may be dried via heated contact between the unmarked side 326 of web 120 and a first circumferential portion of each of the first rollers 350-359 (e.g., referred to as an outer circumferential portion of rollers 350-359 that faces generally away from drum 210 along the radial direction 214) as web 120 travels in the first direction along the arc. Web 120 may be further dried via heated contact between the unmarked side 326 of web 120 and a second circumferential portion of each of the first rollers 350-359 (e.g., referred to as an inner circumferential portion of rollers 350-356 that faces generally toward drum 210 along radial direction 214) as web 120 travels in the second direction along the arc in a reverse direction but which now interleaves in a zigzag pattern between the second rollers 360-369 and the first rollers 350-359.

As further illustrated in FIG. 3, a roller (e.g., roller 369) among the second rollers 360-369 which is first to receive web 120 from drum 210 may be positioned closer to drum 210 along the radial direction 214 than other second rollers (e.g., rollers 368-360) which may be positioned in an interlaced configuration described above. In other words, rollers 359/369 which tension/transport web 120 around drum 210 may be positioned in a non-interlacing configuration such that web 120 does not contact first roller 359 as it travels between second roller 369 and second roller 368. The closer position of the second roller 369 to drum 210 enables a relatively large wrap angle of web 120 around drum 210 (e.g., 300 degrees or more) while avoiding interference with other portions of the web path as web 120 reverses direction in enclosure 302. That is, the second roller 369 is positioned along the radial direction 214 between drum 210 and the portion of web 120 traveling between the first roller 359 and drum 210.

In this configuration with rollers 350-359 and 360-369 in curved patterns around drum 210, the path length of web 120 inside enclosure 302 may be substantially increased with little or no increase in space or footprint of drying system 300 as compared with traditional drum dryers. Furthermore, the roller configuration enables a high degree of drying control of web 120 since drying system 300 may use nearly the entire circumference of drum 210 as well as an increased number of heat contactable surfaces for web 120. As described in greater detail below, the particular positions of drum 210, the first rollers 350-359, and the second rollers 360-369 also enables numerous configurations of drying system 300 for adapting to a wide range of drying requirements.

Figure 4:
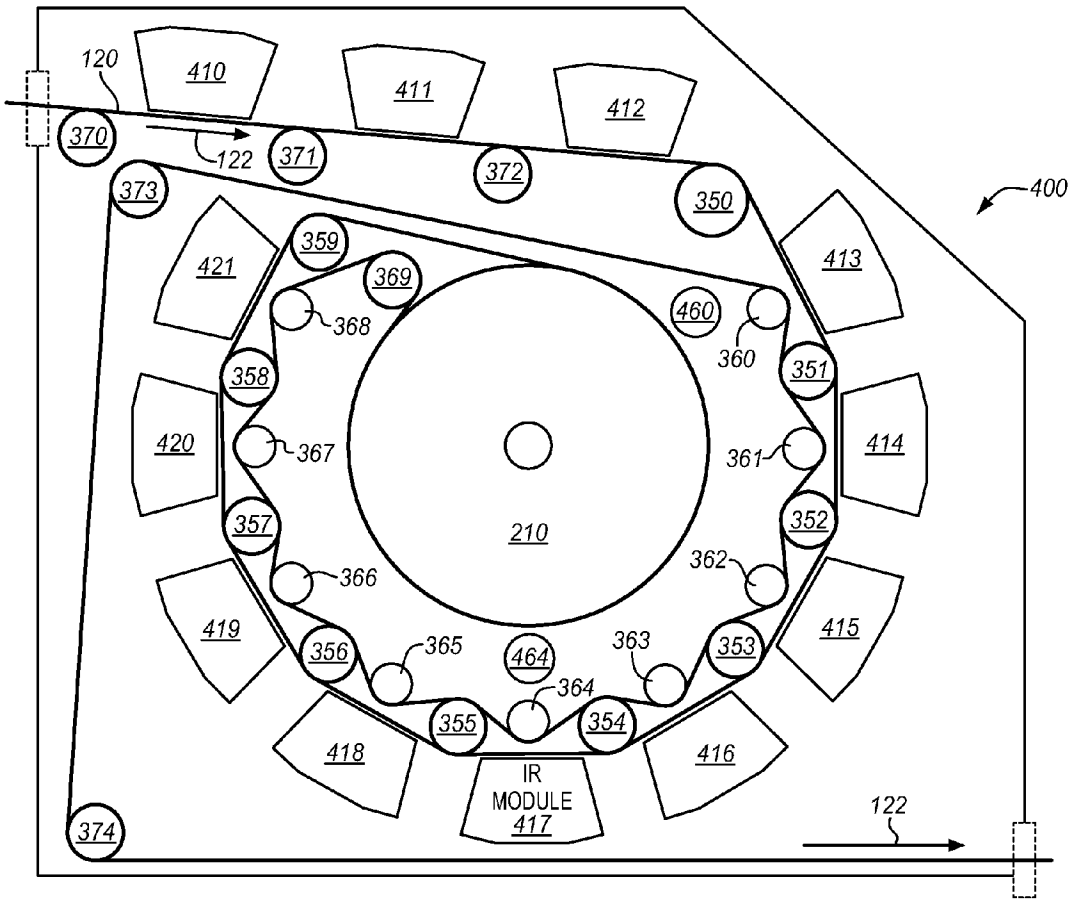
FIG. 4 illustrates a drying system that includes a drum and a roller configuration that facilitates adjustment of the path length of a web in an exemplary embodiment.

FIG. 4 illustrates a drying system 400 that includes drum 210 and a roller configuration that facilitates adjustment of the path length of web 120 in an exemplary embodiment. The configuration is generally similar to that already described for FIG. 3 in that the first rollers 350-359 and the second rollers 360-369 are positioned in an arc around drum 210. In addition, drying system 400 may include additional second rollers 460/464 and radiant energy sources 410-421. In this example, the first rollers 350-359, the second rollers 360-369, and the additional second rollers 460/464 may have fixed positions inside enclosure 302.

The position of the additional second rollers 460/464 enable web 120 to be manually re-threaded according to a desired path length in drying system 400. As shown in FIG. 4, the additional second rollers 460/464 are at a fixed position inside enclosure 302 that is closer to drum 210 along the radial direction 214 than other second rollers (e.g., rollers 368-360), and thus may be similarly positioned as the second roller 369 as described above. For a long path configuration, web 120 may be threaded such that rollers 369/359 transport web 120 around drum 210 to achieve a long path configuration. For a medium path length configuration, web 120 may be threaded such that rollers 464/354 transport web 120 around drum 210. For a short path configuration, web 120 may be threaded such that rollers 460/350 transport web 120 around drum 210.

Suppose, for example, that is desirable for drying system 400 to heat web 120 of three different types: an offset-coated paper, an inkjet treated paper, and a bond paper. Each of these web types involves different drying requirements than the others. Offset-coated paper calls for long, precisely controlled heat exposure, inkjet treated paper generally needs less heat exposure than offset-coated paper, and bond paper may be dried with even less heat exposure. If a conventional drum dryer having a long enough media path to properly dry the offset-coated paper is also used for drying the inkjet treated paper and the bond paper, there will be a large amount of paper waste due to the unnecessarily long media path for those media types. Furthermore, a conventional drying system incurs unnecessary energy costs in operating a radiant energy source along a part of the media path which is extraneous for that media type. For this reason, prior printing systems often use two or more dryer types to accommodate a range of drying requirements.

In drying system 400 shown in FIG. 4, the position of the second roller 369, the additional second roller 464, and the additional second roller 460 enable a long path configuration, a medium path configuration, and a short path configuration, respectively. Drying system 400 may therefore accommodate a large range of drying requirements with one dryer structure. As further illustrated in FIG. 4, drying system 400 may include a plurality of radiant energy sources 410-421 positioned along the web path including the arced path of web 120 traveling over the first rollers 350-359. Radiant energy sources 410-421 may emit infrared (IR) or near-infrared (NIR) energy to heat the first rollers 350-359 and the marked side 324 of web 120 as web 120 travels along the arc toward drum 210. As described in greater detail below, this configuration allows drying system 400 to efficiently heat web 120 in each path length configuration.

Drying system 400 may implement a long path configuration (shown in FIG. 4) for instances in which web 120 is an offset-coated paper. Here, web 120 may be threaded such that it travels across all of the first rollers 350-359 in the first direction, wraps around drum 210 between the first roller 359 and the second roller 369, and then travels across all of the second rollers 360-369 in the second direction. The particular position of entrance rollers 370-372, the first rollers 350-359, the second rollers 360-369, and exit rollers 373-374 (as well as the circumference of drum 210) maximize the travel distance of web 120 from dryer entrance 304 to dryer exit 306 (e.g., 35-45 feet of path length). In the long path configuration, the additional second rollers 460/464 are unused but positioned out of the way of the web path. Additionally, all of radiant energy sources 410-421 may be powered to heat each of the first rollers 350-359 and/or web 120 along the entire arc to allow for precise heat control along the long web path. Drum 210 and/or one or more of the first rollers 350-359 may alternatively or additionally include radiant energy source(s) 410-421 disposed inside to radiate heat internally.

Figure 5:
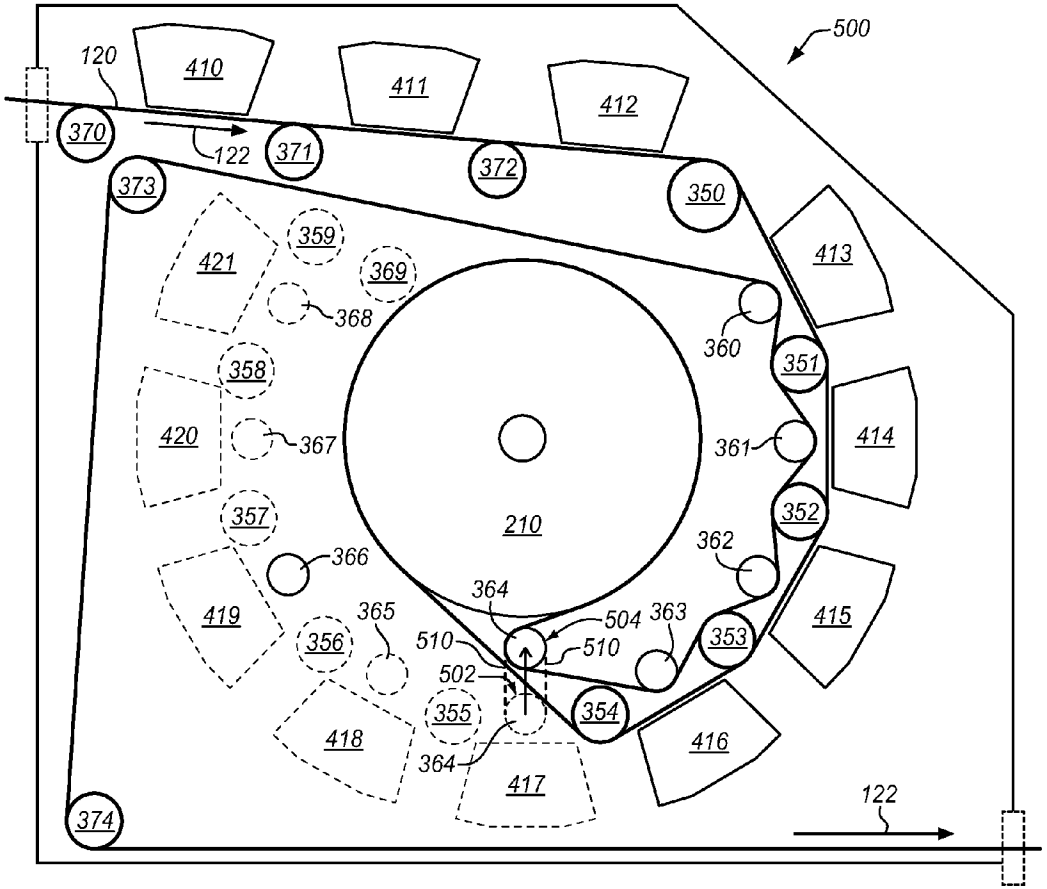
FIG. 5 illustrates a drying system that includes a drum and a roller configuration that facilitates a reduced path length of a web in an exemplary embodiment.

FIG. 5 illustrates a drying system 500 that includes drum 210 and a roller configuration that facilitates a reduced path length of web 120 in an exemplary embodiment. In FIG. 5, drying system 500 implements a medium path configuration and the second roller 364 is configured to move between a first position 502 and a second position 504. In the first position 502, the second roller 364 operates as shown and described previously with respect to FIGS. 3-4. In the second position 504, the second roller 364 replaces the second roller 369 as the first to receive web 120 from drum 210 and that turns/reverses web 120 for travel of web 120 in the second direction.

FIG. 5 is similar to the configuration described above with respect to FIG. 4 but shows an alternative to a fixed roller embodiment. In that regard, drying system 500 may include a track 510 that guides the second roller 364 to multiple positions along the radial direction 214. For example, track 510 may include a rail that enables sliding of the second roller 364 towards and away from drum 210 and a latch that locks the position of the second roller 364. Alternatively or additionally, enclosure 302 of drying system 500 may include grooves, fasteners, etc. at various locations on its walls to enable the second roller 364 to be detached and reattached at the first position 502 and the second position 504 or other similar locations.

Drying system 500 may implement a medium path configuration (shown in FIG. 5) for instances in which web 120 is an inkjet treated/coated paper. Here, web 120 may be threaded such that it travels across first rollers 350-354 (skips first rollers 355-359) in the first direction, wraps around drum 210 between the first roller 354 and the second roller 364 in the second position 504 (or alternatively the additional second roller 464 for fixed roller embodiments such as that shown and described with respect to FIG. 4), and then travels across second rollers 364-360 (skips second rollers 369-365 as well as first rollers 359-355) in the second direction. Thus, in the medium path configuration, web 120 no longer travels over the far end of the arc (far being defined with respect to a travel distance of web 120 from dryer entrance 304). Since a portion of the arc is skipped in both the first direction and second direction, the travel distance of web 120 from dryer entrance 304 to dryer exit 306 is reduced as compared with the long path configuration (e.g., to a path length of 25-35 feet).

Additionally, drying system 500 may deactivate radiant energy sources 417-421 that correspond with the skipped portion of the arc. Compared with the long path configuration, drying system 500 implementing the medium path configuration operates with radiant energy sources 410-416, first rollers 350-354, and second rollers 360-364. Therefore, in addition to providing a reduced path length of web 120 to reduce paper waste, the arced positioning of rollers 350-359/360-369 and radiant energy sources 410-421 allows drying system 500 to optionally operate in a high-performance mode (e.g., long path configuration shown in FIG. 4) and to still use its energy efficiently if the high-performance mode is no longer necessary (e.g., medium path configuration shown in FIG. 5).

Figure 6:
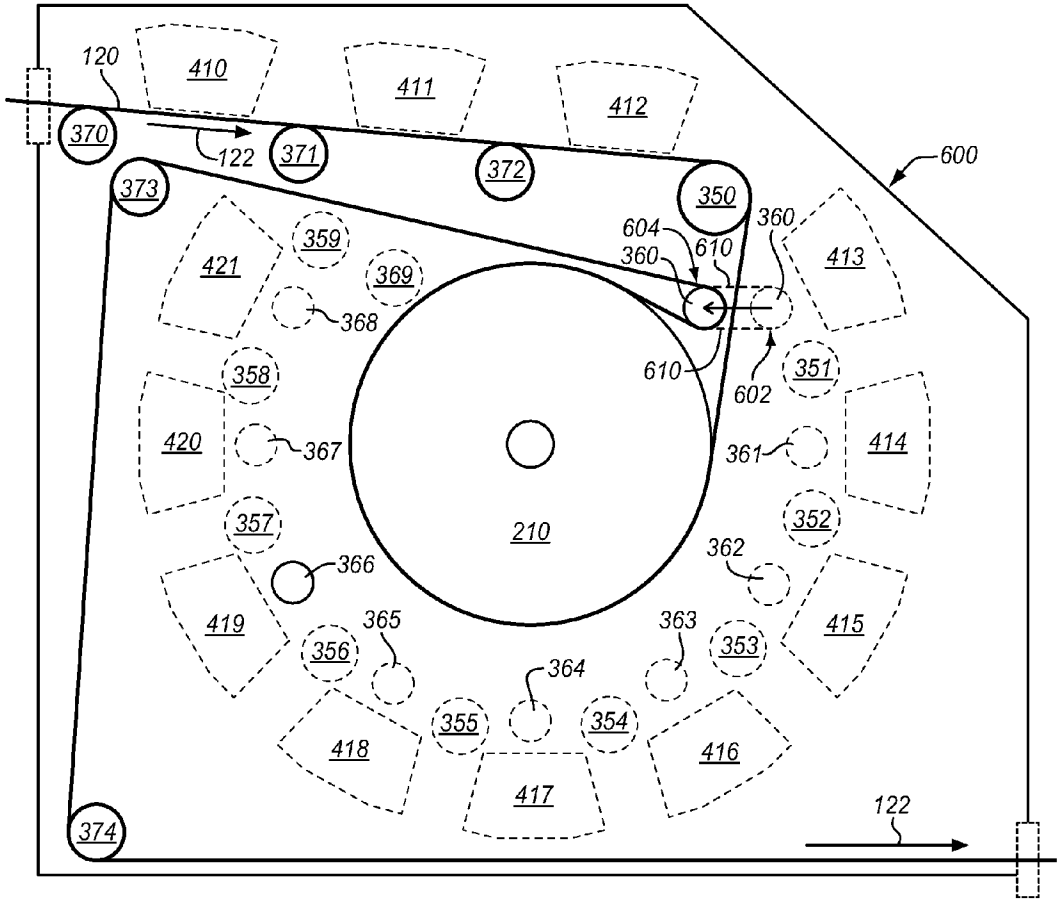
FIG. 6 illustrates a drying system that includes a drum and a roller configuration that facilitates a minimized path length of a web in an exemplary embodiment.

FIG. 6 illustrates a drying system 600 that includes drum 210 and a roller configuration that facilitates a minimized path length of web 120 in an exemplary embodiment. In FIG. 6, drying system 600 implements a short path configuration and the second roller 360 is configured to move between a first position 602 and a second position 604. Thus, drying system 600 may include track 610 or other means similar to that already described above in FIG. 5 for adjusting the second roller 360 toward and away from drum 210. In the first position 602, the second roller 360 operates as shown and described previously with respect to FIGS. 3-5. In the second position 604, the second roller 360 is the first to receive web 120 from drum 210 and it turns/reverses web 120 for travel of web 120 to dryer exit 306.

Drying system 600 may implement a short path configuration (shown in FIG. 6) for instances in which web 120 is a bond paper. Here, web 120 may be threaded such that it travels across first roller 350 (skips first rollers 351-359 along the arc in the first direction), wraps around drum 210 between the first roller 350 and the second roller 360 in the second position 604 (or alternatively the additional second roller 460 for fixed roller embodiments such as that shown and described with respect to FIG. 4), and then travels from the second roller 360 to dryer exit 306 (skips second rollers 369-361 as well as first rollers 359-351 in the second direction). Thus, in the short path configuration, web 120 bypasses the arc almost entirely to reduce the travel distance of web 120 from dryer entrance 304 to dryer exit 306 even further (e.g., to a path length of 15-25 feet). Additionally, drying system 600 may deactivate any of radiant energy sources 413-421 that correspond with the bypassed portion of the arc. Drying system 600 may also deactivate radiant energy sources 410-412 positioned over entrance rollers 370-372 which are not arranged along the arc depending on the particular drying application desired. Thus, drying system 600 implementing the short path configuration may also operate with an efficient use of paper and energy.

In addition to the ability to adapt to a large range of drying applications, the configuration of drying system 120 described above advantageously allows similar, efficient use of drum 210 in each of the long, medium, and short path configurations. As shown and described above, the position of the second roller 369, the additional second roller 464 (or the second roller 364 in the second position 504), and the additional second roller 460 (or the second roller 360 in the second position 604) enables a relatively large wrap angle of web 120 around drum 210 (e.g., 300 degrees or more) while avoiding interference with other portions of the web path as web 120 reverses direction in enclosure 302 in each path configuration. Thus, the two rollers that transport web 120 around drum 210 (e.g., rollers 359 and 369 in the long path configuration, rollers 354 and 364 (or 464) in the medium path configuration, and rollers 350 and 360 (or 460) in the short path configuration) may have equal or similar relative positioning in each path length configuration such that an equal or similar amount wrap angle of web 120 around drum 210 is achieved regardless of the particular path configuration being used. For instance, heating of web 120 by an internally heated drum 210 may be efficiently achieved with a relatively large wrap angle that is independent of drying length prior to contact between drum 210 and web 120.

Furthermore, since the adjustable path length configuration described allows drying system 600 to perform effectively and efficiently in high performance drying applications and more simple drying applications alike, drying system 600 may be manufactured using a common frame and connections for installing rollers 350-359/360-369 (and/or radiant energy sources 410-421) in an arc around drum 210. Print shops or users of printing system 100 may therefore have the option of purchasing/installing components which suit a particular drying need or a range of drying needs, and/or may use drying system 600 with a variety of different printing systems, print jobs, web types, etc. This flexibility allows for a single design to be priced appropriately for various drying/hardware requirements.

In one embodiment, drying system 600 includes a concentric arrangement of components similar to that shown and described. In such an arrangement, drum 210 may be positioned at or near a relative center of enclosure 302 and components are positioned along concentric arcs around drum 210 which are spaced from one another in the radial direction 214. The first arc closest to drum 210 includes the second roller 369, the additional second roller 464 (or the second roller 364 in the second position 504), and the additional second roller 460 (or the second roller 360 in the second position 604). The second arc includes the second rollers 360-369, and the third arc includes the first rollers 350-359 (e.g., centers of the second rollers 360-369 closer to drum 210 than centers of the first rollers 350-359). The fourth arc is furthest from drum 210 and includes radiant energy sources 410-421. Since the span of the arc(s) tends to define the range of potential path length and dryer adjustments, each arc may span a substantial circumferential portion of drum 210 (e.g., 270 degrees or more). The arc(s) may also comprise circular-shaped paths that have a uniform distance from the circumference of drum 210 and/or to other arcs as shown in FIGS. 3-6. However, alternative arc span amounts, non-uniform arc paths, non-circular arc paths, and combinations of different arcs are possible within drying system 300, 400, 500, and 600. Additionally, drying system 300, 400, 500, and/or 600 may implement a different number or combination of components in arc(s) and/or a different number of path length adjustment options other than that explicitly shown and described.

In another embodiment, the first rollers 350-359 include a thermally conductive material that heats to a desired temperature via radiant energy sources positioned between the first rollers 350-359 along the arc in the circumferential direction 216 (e.g., similar to that shown and described with respect to FIG. 4 and radiant energy sources 413-421). The second rollers 360-369 (and/or entrance/exit rollers 370-374) may include non-conductive material that is ambient or near ambient during operation of the radiant energy sources. In this configuration, web 120 may receive heat via the first rollers 350-359 and the radiant energy sources 413-421 as web 120 travels in the first direction, and energy passing through web 120 may be recovered at drum 210 for efficient energy use in drying system 300. However, it will be appreciated that any of the rollers of drying system 300 may be selectively heated, cooled, or ambient in temperature in any number of combinations to provide a desired transfer of thermal energy to web 120, and may also be driven, idle, rotatable, or non-rotatable in any number of configurations.

In yet another embodiment, drying system 300, 400, 500, and/or 600 may be configured to adjust a distance of one or more of the first rollers 350-359 relative to one or more of the second rollers 360-369 along the radial direction 214. For example, each adjustable roller may be configured with a track or other movement mechanism similar to that described above for the second rollers 360/364 in FIGS. 4-5. The movement allows the rollers to disengage to a non-interlacing position (e.g., for paper threading, roller cleaning, a particular drying application, etc.) and/or to adjust the amount of interlacing to cause a corresponding adjustment in wrap angle or heat applied to web 120.

The particular arrangement, number, and configuration of components described herein is exemplary and non-limiting. Although specific embodiments were described herein, the scope of the inventive concepts is not limited to those specific embodiments. The scope of the inventive concepts is defined by the following claims and any equivalents thereof.

What is claimed is:

1. A system comprising:

a dryer of a printing system comprising:

a drum configured to rotate about an axis, and to apply heat to a web of print media to dry ink applied to the web;

first rollers positioned in an arc around the drum to define a web path along the arc between an entrance of the dryer and the drum; and second rollers positioned inside the arc from the first rollers that reverse the web path inside the arc between the drum and an exit of the dryer;

wherein a first roller directs the web path toward a surface of the drum, a second roller directs the web path from the surface of the drum, and a location of the first roller and the second roller relative to the arc defines a length of the web inside the dryer.

2. The system of claim 1 wherein:

the length of the web inside the dryer is a first distance when the location of the first roller and the second roller is at a far end of the arc with respect to a travel distance of the web from the entrance of the dryer;

the length of the web inside the dryer is a second distance that is less than the first distance when the location of the first roller and the second roller is between the far end of the arc and a near end of the arc that is closer to the entrance of the dryer than the far end of the arc; and the length of the web inside the dryer is a third distance less than the second distance when the location of the first roller and the second roller is at the near end of the arc.

3. The system of claim 2 wherein:

for each of the first distance, the second distance, and the third distance, the length of the web between the first roller and the second roller is equivalent.

4. The system of claim 3 wherein:

for each of the first distance, the second distance, and the third distance, an amount of wrap angle of the web around the drum is equivalent.

5. The system of claim 2 wherein:

for the second distance and the third distance, the second roller is adjustable along a radial direction with respect to the drum.

6. The system of claim 1 wherein:

the first rollers are configured to apply heat to the web to dry ink applied to the web; and the second rollers interlace with the first rollers along the arc to transport the web in an alternating fashion with the first rollers when the web is between the drum and an exit of the dryer.

7. The system of claim 6 wherein:

each of the first rollers include an inner circumferential portion that faces toward the drum and an outer circumferential portion that faces away from the drum;

the outer circumferential portion of each of the first rollers define the web path as the web travels between the entrance of the dryer and the drum; and the inner circumferential portion of each of the first rollers define the web path as the web travels between the drum and the exit of the dryer.

8. The system of claim 6 further comprising:

radiant energy sources positioned beyond the arc with respect to a radial direction of the drum and configured to radiate heat between the first rollers toward the web.

9. The system of claim 1 wherein:

a circumference of the drum is larger than a circumference of the first rollers and the second rollers.

10. The system of claim 1 wherein:

the first rollers define the web path along the arc in a first direction; and the second rollers define the web path along the arc in a second direction opposite to the first direction.

11. The system of claim 1 wherein:

the arc is uniformly distanced from a circumference of the drum and spans a circumferential portion of the drum that is at least 270 degrees; and the web path along the arc of the first rollers is circular.

12. The system of claim 11 wherein:

the first rollers define the web path along the arc in a first circular direction; and the second rollers define the web path inside the arc in a second circular direction opposite to the first circular direction.

13. The system of claim 1 further comprising:

a continuous-forms printing system that marks the web upstream from the dryer.

14. A web handling apparatus comprising:

an enclosure that includes an entrance for receiving a web with wet ink and an exit for discharging the web with dried ink;

a drum that heats the web as the web wraps around the drum;

a first group of rollers spaced along an arc that spans around a circumferential portion of the drum at a first distance from a surface of the drum, wherein the first group of rollers transport the web between the entrance of the enclosure and the drum, and wherein a last roller among the first group of rollers turns the web onto the drum;

a second group of rollers that occupy spaces between the first group of rollers, the second group of rollers positioned inside the arc to span around the drum at a second distance closer to the surface of the drum than the first distance, wherein the second group of rollers transport the web between the drum and the exit of the enclosure; and a third group of rollers positioned closer to the drum than the second distance, wherein one roller among the third group of rollers transports the web from the drum to the second group of rollers;

wherein a location of the last roller and the one roller relative to the arc defines a travel distance of the web inside the enclosure.

15. The web handling apparatus of claim 14 wherein:

the travel distance of the web inside the enclosure is a first length when the location of the last roller and the one roller is at a far end of the arc relative to the entrance of the enclosure with respect to travel of the web;

the travel distance of the web inside the enclosure is a second length shorter than the first length when the location of the last roller and the one roller is between the far end of the arc and a near end of the arc that is closer to the entrance of the enclosure than the far end of the arc with respect to travel of the web; and the travel distance of the web inside the enclosure is a third length shorter than the second length when the location of the last roller and the one roller is at the near end of the arc relative to the entrance of the enclosure with respect to travel of the web.

16. The web handling apparatus of claim 14 wherein:

the third group of rollers includes multiple rollers having fixed positions inside the enclosure at a third distance closer to the surface of the drum than the second distance.

17. The web handling apparatus of claim 14 wherein:

the third group of rollers includes one or more rollers configured to adjust between a first position which is a third distance closer to the surface of the drum than the second distance, and a second position which is the second distance from the surface of the drum.

18. The web handling apparatus of claim 14 wherein:

the first group of rollers transport the web along the arc in a first circular direction; and the second group of rollers transport the web inside the arc in a second circular direction opposite to the first circular direction.

19. The web handling apparatus of claim 18 wherein:

the second group of rollers interlace with the first group of rollers to alternate contact of the web with the second group of rollers and the first group of rollers as the web travels inside the arc in the second circular direction.

20. The web handling apparatus of claim 14 wherein:

the circumferential portion of the drum which the first rollers span around in the arc is 270 degrees or more.

* * * * *